US005365757A

United States Patent [19]

Primeau

[11] Patent Number: 5,365,757

[45] Date of Patent: Nov. 22, 1994

[54] SAFETY LOCK

[76] Inventor: Mario Primeau, 6260, rue Marivaux, bureau 204, St-Léonard (Qué), Canada, H1P 3K3

[21] Appl. No.: 78,858

[22] Filed: Jun. 21, 1993

[51] Int. Cl.[5] ..... E05B 73/00

[52] U.S. Cl. ..... 70/14; 70/DIG. 63; 292/307 R

[58] Field of Search ..... 70/14, 18, 176–178, 70/164, 180, 30, 49, 203, 457, DIG. 63, DIG. 30; 292/307 R, 307 A, 307 B

[56] References Cited

U.S. PATENT DOCUMENTS

| | | | |
|---|---|---|---|
| 1,197,020 | 9/1916 | Farrar | 70/203 |
| 2,816,434 | 12/1957 | Olson | 70/457 |
| 3,372,952 | 3/1968 | Newton | 292/307 |
| 3,568,482 | 3/1971 | Shears | 70/457 |
| 3,703,821 | 11/1972 | Dorey | 70/38 R |
| 4,864,834 | 9/1989 | Waite | 70/14 |
| 5,020,342 | 6/1991 | Doan et al. | 70/14 |

FOREIGN PATENT DOCUMENTS

| | | | |
|---|---|---|---|
| 2330833 | 6/1977 | France | 70/18 |

OTHER PUBLICATIONS

"Lock Out Employee Injuries", 1992 General Catalog Personal & Environmental Safety, Lab Safety Supply pp. 395–397 ©1991 1st Ed.

*Primary Examiner*—Peter M. Cuomo
*Assistant Examiner*—Darnell M. Boucher
*Attorney, Agent, or Firm*—Pierre Lespérance; Francois Martineau

[57] ABSTRACT

A safety lock defining one and another, substantially rigid, elongated legs, the one leg defining an outer first leg portion and an inner second leg portion, and the another leg defining an inner third leg portion and an outer fourth leg portion, and an arcuate web integrally joining the second and third leg portions; the web being made from a resilient material whereby the web forms a hinge for relative movement of the one and another legs; the fourth leg portion including a channel, being releasably engaged by the first leg portion whereby the second and third leg portions form with the web a large shackle-like structure for use in locking a utility control box, and ears, for use in receiving the small shackle of at least a few padlocks whereby the first leg portion thereafter becomes locked into the channel; and a notch arrangement, for automatically but releasably retaining a free end tip of the first leg portion against the channel distal end, even when no padlock shackle engages a corresponding ear.

6 Claims, 5 Drawing Sheets

FIG.7
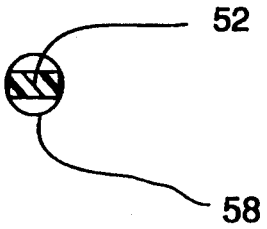
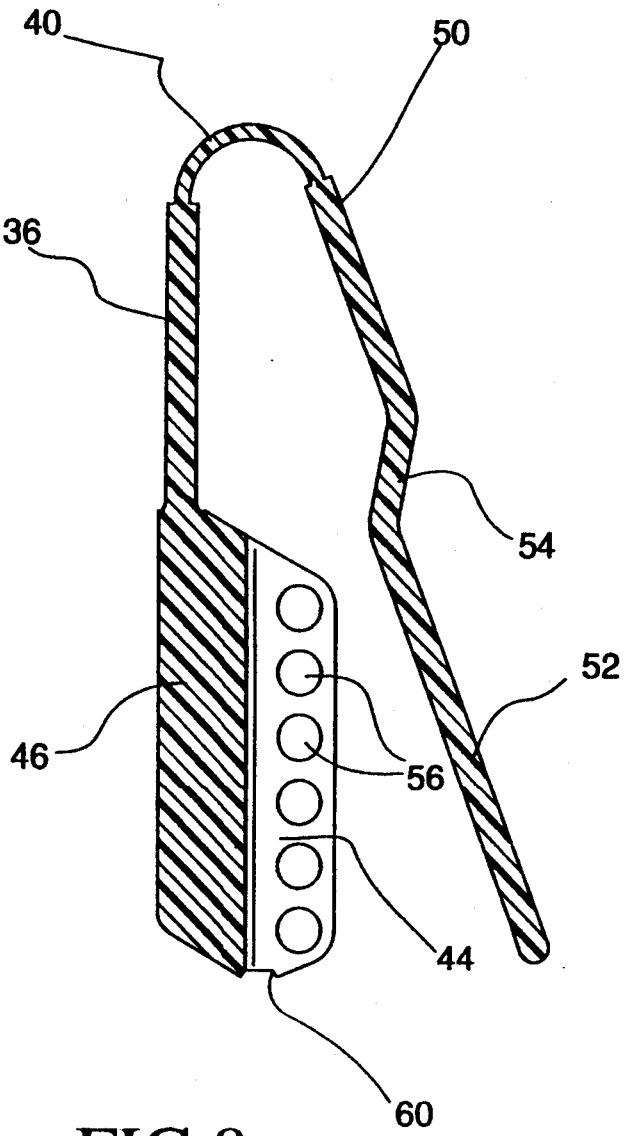
FIG.8
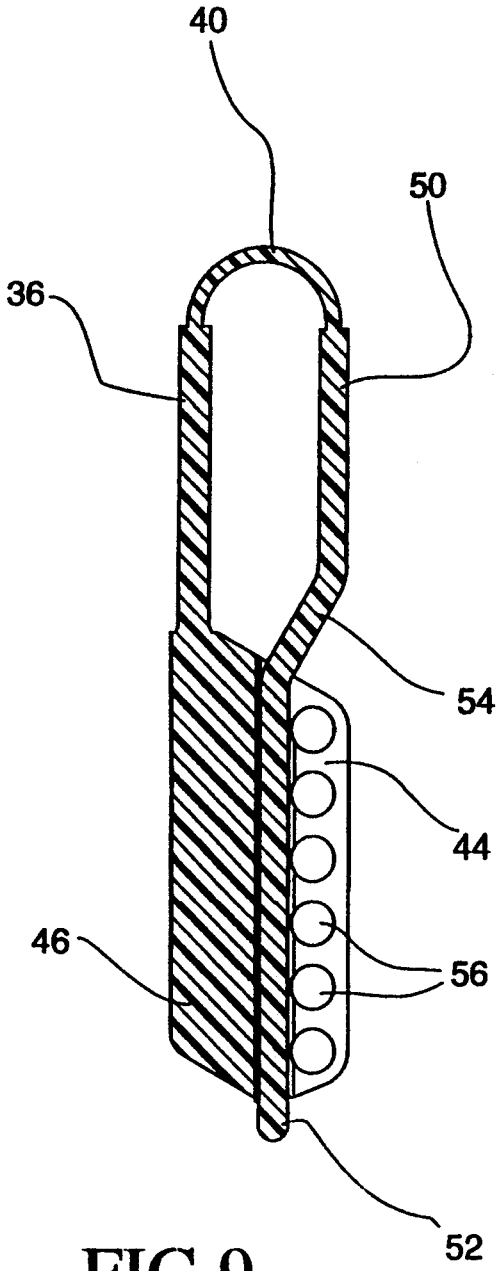
FIG.9

FIG.10
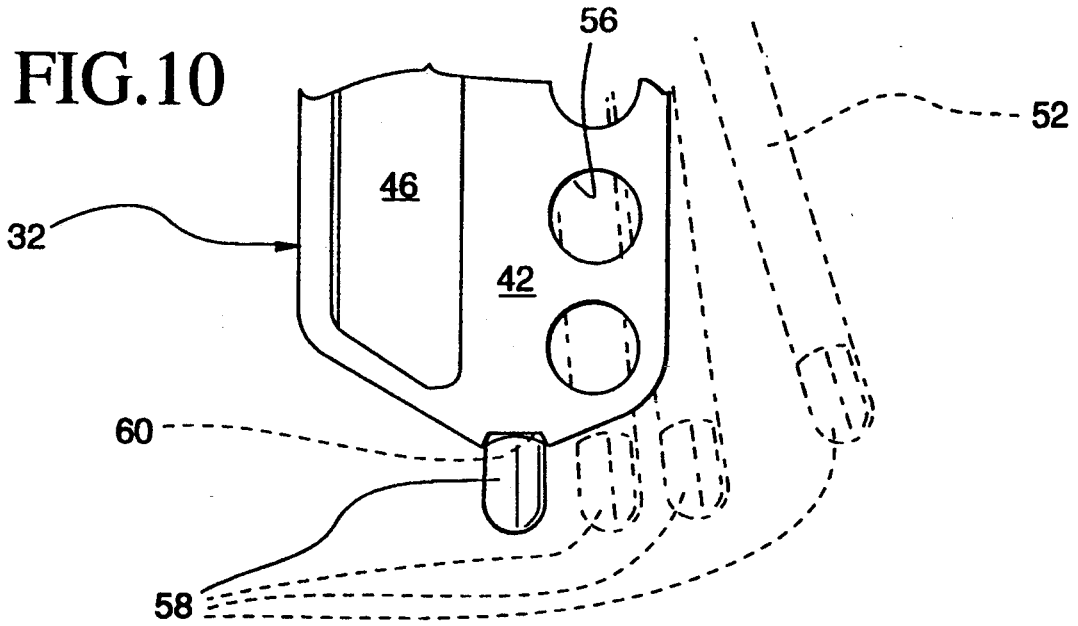
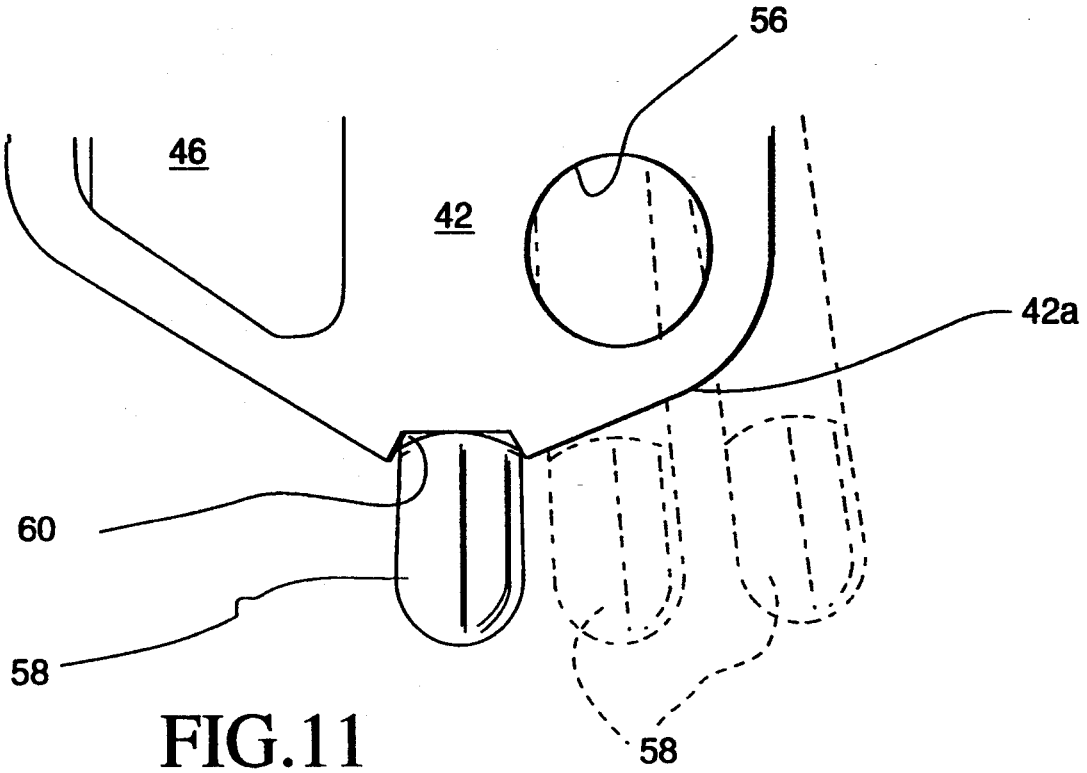
FIG.11

SAFETY LOCK

FIELD OF THE INVENTION

This invention relates to locking clamps having two arms that can be closed and locked in closed condition by more than one padlock.

BACKGROUND OF THE INVENTION

It is recognized that accidents occurring in industrial environments are often a consequence of carelessness. Simple, low cost precautionary measures can sometimes make a big difference in industrial accident occurrence rate. One such known safety measure consists in providing a locking member having at least a few padlock shackle engaging bore means, wherein the keys for the various padlocks are to be held by a number of different persons. Therefore, if for example an electrician is working on an electrical line, it is critical that voltage not be applied to the line during such maintenance, otherwise severe injuries and/or death can occur by contacting a live electrical line. The electrician will have himself closed the power lever in the control box, but, if the electrician works at a distance from this electrical control box, he may not be able to detect the presence of another fellow worker who could think that "someone has again forgotten to put the power line on", and thus decided to reopen the electrical power lever. Having more than one padlock to lock such an electrical control box is desirable, since more than one person would need to authorize such unlocking, and any of these persons could put his veto on the unlocking of the locking device, a desirable safety feature.

One such example of multi-padlock safety lock member is disclosed in U.S. Pat. No. 5,052,939 issued on Oct. 1, 1991 to William KOCH.

It is understood that with these safety locks, the idea is not really to deter a person having a criminal intention, but more so to prevent accidents provoked mainly by carelessness.

One drawback of these known safety locks is that, once all the padlocks are disengaged from the safety lock ears, the two arms constituting the safety lock will tend to freely open up, which could undesirably lead to the accidental release of the safety lock from the control box.

OBJECTS OF THE INVENTION

The gist of the present invention is therefore to improve upon existing multi-padlock locking clamps.

A more specific object of the present invention is to provide a safety lock having two relatively movable arms, which will releasably remain in their closed position even though all the padlocks are removed.

SUMMARY OF THE INVENTION

According to the objects of the invention, there is disclosed a safety lock defining one and another, substantially rigid, elongated leg members, said one leg member defining an outer first leg portion and an inner second leg portion, and said another leg member defining an inner third leg portion and an outer fourth leg portion, and an arcuate web member integrally joining said second and third leg portions; said web member being made from a resilient material whereby said web member forms hinge means for relative movement of said one and another leg members; said fourth leg portion including channel means, being releasably engaged by said first leg portion whereby said second and third leg portions form with said web member a large shackle-like member for use in locking a utility control box, and ear means, for use in receiving the small shackle of at least one padlock whereby said first leg portion thereafter becomes locked into said channel means; and retaining means, for automatically but releasably retaining said first leg portion into said channel means, even when a padlock shackle does not engage said ear means.

Preferably, the resiliency of said web member further enables forcible displacement in a longitudinal axial direction of said one leg member relative to said another leg member, and wherein said retaining means includes: (a) an enlarged end tip, at the free end of said first leg portion; and (b) notch means, at a distal end of said channel means located on the opposite side of said third leg portion, for frictionally receiving said enlarged end tip; wherein, upon said first leg portion being released from said channel means, said first leg portion becomes fully reengageable into said channel means solely upon said enlarged end tip being made to engage into said notch means, said enlarged end tip being itself engageable into said notch means solely upon forcibly applying an axial bias on said one leg member to extend the latter so that said enlarged leg tip be allowed to clear said channel means distal end.

Alternately or concurrently with the preceeding embodiment of said retaining means, said retaining means could also consist of a friction fit engagement of said first leg portion within said channel means.

Advantageously, said ear means further includes means for receiving the small shackles of at least a few padlocks, whereby said first leg portion thereafter becomes locked into said channel means.

It is envisioned that said notch means defines a generally U-shape with diverging side legs. Said enlarged leg tip could be cylindrical.

Preferably, said one leg member further includes an intermediate, inturned elbowed section joining said first and second leg portion, whereby said shackle-like member is approximately as large as the releasably interconnected said first and fourth leg portions.

Advantageously, said channel means distal end is tapered, to facilitate sliding engagement of said enlarged leg tip into said notch means.

BRIEF DESCRIPTION OF THE DRAWINGS

FIGS. 6 and 7 are cross-sectional views taken along lines 6—6 and 7—7 respectively of FIG. 4;

FIGS. 8 and 9 are sectional views taken along line 8—8 of FIG. 5, with the safety lock being respectively in opened and closed condition; and FIGS. 10 and 11 are enlarged views of the lower part of FIG. 3, suggesting in shadow outline the transverse play of the finger through the channel means, FIG. 11 being at a still larger scale relative to FIG. 10.

DETAILED DESCRIPTION OF THE INVENTION

Figure 1:
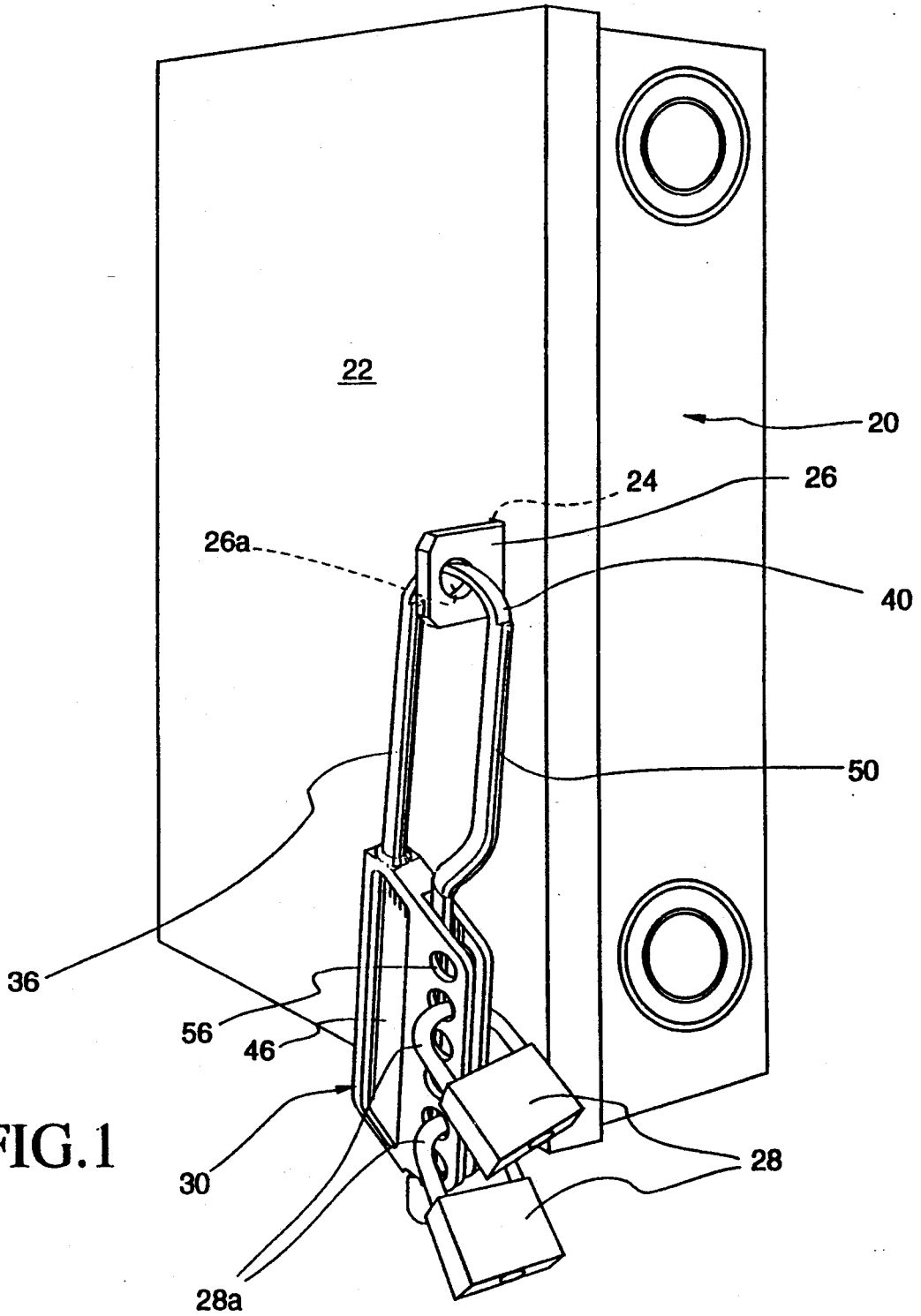
FIG. 1 is an isometric view of an electric box, with the cover thereof being locked by a multi-padlock safety lock according to the invention.

In the drawings, FIG. 1 illustrates a typical electric box 20, to be mounted e.g. to the inside vertical wall of a house. The box 20 has a front door 22 hinged on one side and having an aperture 24 through which extends a rigid arm 26 projecting from the inside of the box 20. Arm 26 has a bore 26*a* at its outer free end. Bore 26*a* of arm can be e.g. engaged by the U-shape shackle 28*a* of a padlock 28.

Figure 2:
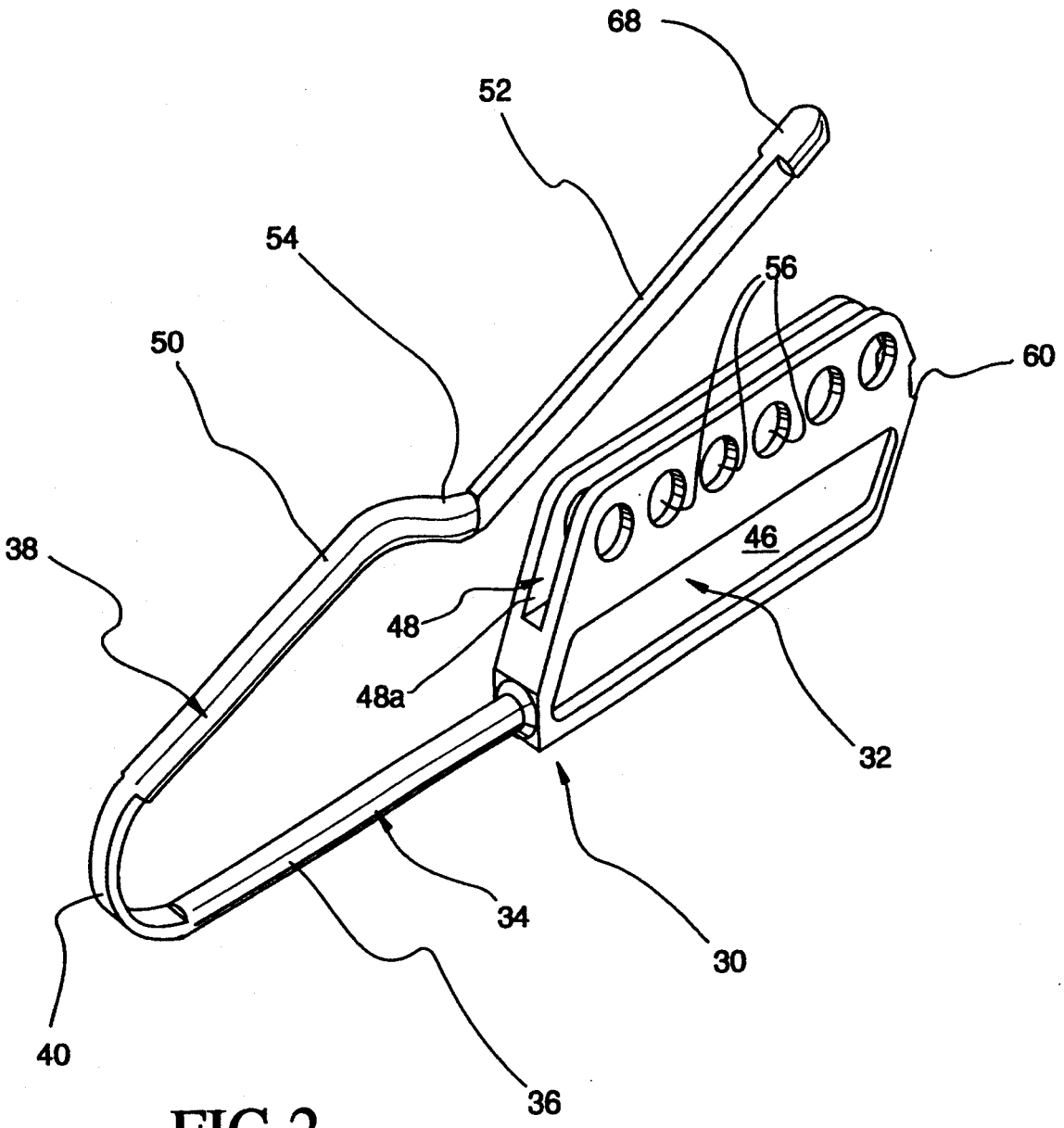
FIG. 2 is a perspective view of the preferred embodiment of safety lock.
Figure 3:
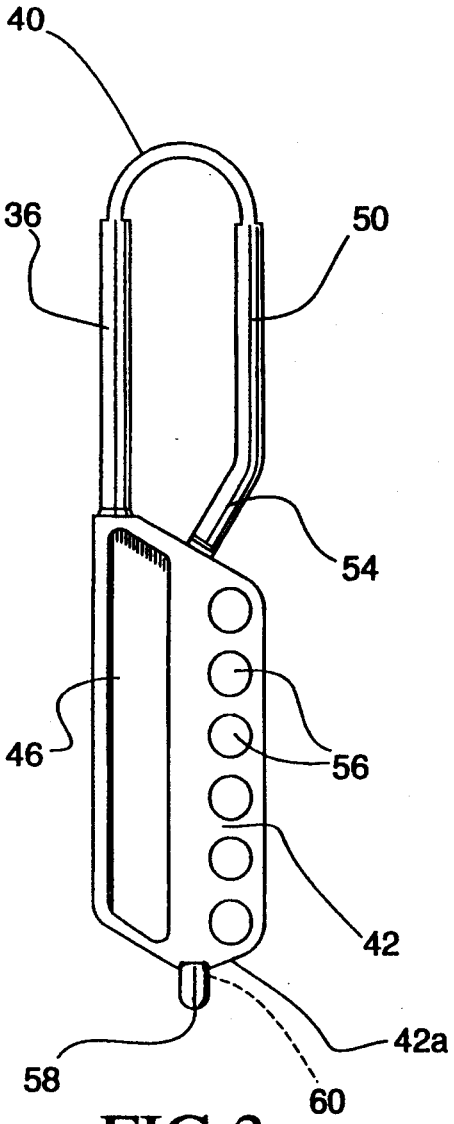
FIGS. 3 and 4 are plan view of the safety lock, respectively in closed and opened condition.
Figure 6:
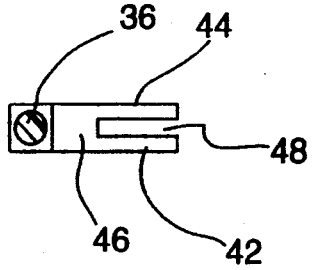
Figure 4:
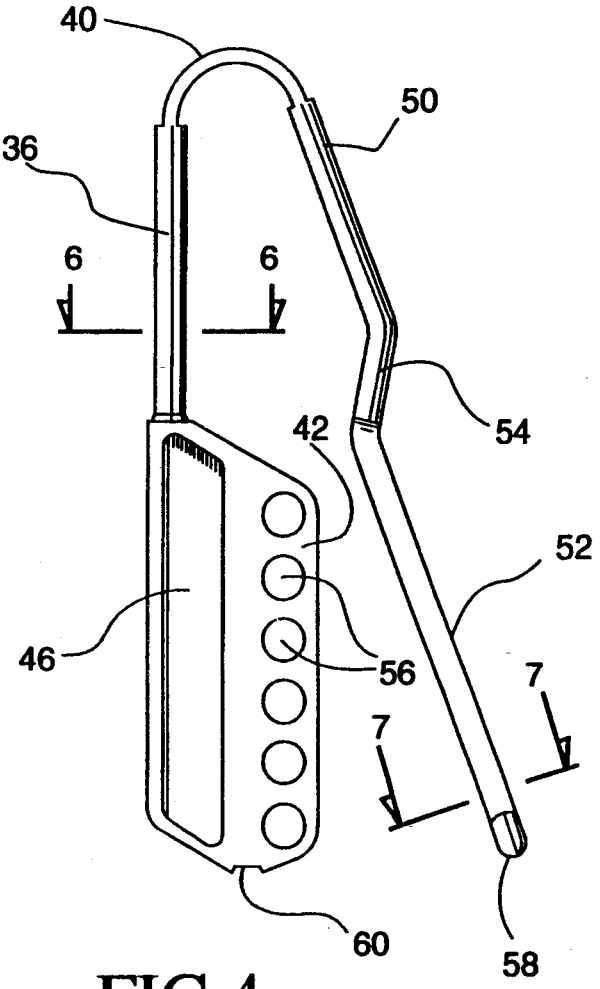

According to the invention, and as illustrated in FIGS. 2–4, there is provided a safety lock, 30, defining a main planar casing 32 and a generally U-shape finger 34 integrally projecting from an edge of casing 32 within the plane thereof. U-shape finger 34 defines inner and outer legs 36, 38, and a web 40 joining the two legs 36 and 38. The inner leg 36 is anchored to and projects transversely from an edge of casing 32. The web 40 should have at least moderate inherent resiliency, to allow relative movement of the legs 36 and 38 relative to one another, i.e. hingedly about web, thereby at least enabling spreading apart motion of outer free end leg 38 relative to the casing 32 and axial (longitudinal) displacement of leg 38 relative to leg 34. The inherent resiliency of web 40 may be for example a 50% reduction in thickness about web 40 of the material (e.g. a plastic material such as polyvinyl chloride) constituting U-shape finger 34.

Figure 5:
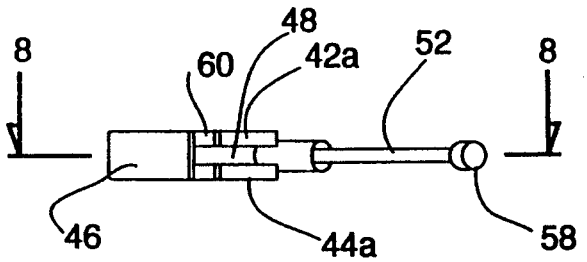
FIG. 5 is an end view of the open safety lock of FIG. 4.

Casing 32 defines a main part, 42, from which projects inner leg 36, and two spaced, integral flanges, 44 and 46, (FIG. 5) extending parallel to one another, whereby an elongated, cross-sectionally U-shape channel 48 is defined between the two flanges 44 and 46. The inner width and depth of channel 48 is substantially constant throughout its length. Elongated channel 48 defines a lengthwise axis most preferably extending in a direction generally parallel to that of inner leg 36, and furthermore defines a plane intersecting said inner leg 36. Inner leg 36 has such a structural rigidity and is anchored to the casing main part 42 in such a way as to substantially retain the same general axial orientation, even when the outer leg 38 is forcibly biased (e.g. by manual force) away from the inner leg 36. The width of U-shape channel 48 corresponds to the distance between the two parallel flanges 42 and 44; its depth corresponds to the distance that each flange 42 and 44 project away from casing 32.

In U-shape finger 34, outer leg 38 includes a straight elongated inner part 50, a straight elongated outer part 52, and an inturned elbow part 54 joining inner and outer leg parts 50 and 52. Preferably, and as suggested in FIG. 2 of the drawings, in the unbiased (natural) condition of U-finger 34, at least outer part 52 of leg 38 extends along a virtual axis being divergent from inner leg 36, so as to generally clear the distal end of casing 32 (i.e. opposite the end from which projects leg 36) including the casing flanges 42 and 44; and outer part 52 should preferably extend naturally within the plane of U-channel 48, in general register therewith. Thinner outer part 52 must be at least as long as the length of U-channel 48, for engagement therein.

Each flange 42 and 44 carries a number of lengthwisely disposed bores, 56, 56, 56, . . . along the longitudinal outer edge portion thereof, wherein a cross-sectionally U-shape subchannel 48*a* is defined between the longitudinal inner edge portions of the flanges 42 and 44, i.e. deeper into the channel 48 than the bores 56. Each bore 56 from flange 42 transversely registers with a corresponding bore 56 from the opposite flange 44, whereby the shackle 28*a* of a given padlock 28 (not forming part as such of the present invention) may freely engage both such registering bores 56, 56, of flanges 42 and 44 through U-channel 48; wherein upon part 52 engaging sub-channel 48*a*, padlock shackle 28*a* traps part 52 therein.

The width of outer part 52 should be smaller than or preferably match the width of the U-channel 48, whereby engagement of the former into the latter is done through friction-fit type engagement; and the thickness of outer part 52 should be smaller or equal to the depth of said U-shape subchannel 48*a*. Preferably, outer part 52 is cross-sectionally quadrangular, most preferably rectangular (thicker than wide). Hence, upon transversely forcibly engaging leg part 52 through U-channel 48 and into U-subchannel 48*a*, and engaging at least one padlock shackle through a pair of registering bores 56, 56 from the two flanges 42 and 44, leg part 52 becomes trapped into U-channel 48. Therefore, leg parts 36, 40 and 50 and the adjacent section of the casing main portion 46, form together a shackle-like member, as illustrated in FIG. 1. If any of leg parts 36, 40 or 50 engage an ear such as ear 26 of control box cover 22, then the safety lock 30 becomes automatically locked thereto.

Accordingly with an important feature of the invention, the free end tip 58 of the leg part 52 is enlarged, i.e. becomes much wider than the width of U-channel 48. Moreover, the distal edges 42*a*, 44*a*, of each flange 42 and 44 (opposite leg part 36) each defines a notch 60, said notches 60 registering with one another and being also in register with subchannel 48*a*. The notches 60 are sized for abutting engagement by the enlarged tip 58 of leg part 52, when leg part 52 engages subchannel 48*a*. These flange distal edges 42*a*, 44*a*, taper relative to the notches 60, to facilitate sliding displacement of the leg part tip 58 toward the notches 60 during engagement of leg part 52 through U-channel 48.

Acuate resilient web leg 40 should pretensioned in such a way as to require that axial pushing force be applied on the leg 38—away from web 40—for tip 58 to reach notches 60. Once tip 58 reaches the two notches, it will move back yieldingly into the notches 60, under the resilient action of the resilient web part 40, once said axial pushing force on leg 38 is released. Such a feature will provide the advantage of being able to maintain the leg part 52 inside subchannel 48*a*, i.e. the safety lock 30 in its locked condition, even when all the padlock(s) 28 are released from the pairs of ears 56 of flanges 42 and 44.

Preferably, leg members 36, 50, 54 and 58 are all of the same cylindrical shape; and the distal edge of enlarged tip 58 is convexly shaped. One preferred material for the present safety lock would be heavy duty nylon. The present multiple lock-out device (safety lock) therefore provides excellent protection against unauthorized access (particularly accidental breakage) for inter alia: electric, gas, water, steam, acid, and pneumatic control units and levers.

I claim:

1. A safety lock of monopiece construction consisting of a main rigid casing, from which transversely project a pair of first and second flanges spaced from one another, and each flange having at least one bore whereby the bores of said first and second flanges are axially aligned in pairs, wherein an elongated channel is defined between said spaced flanges; said channel defining an inner portion, between said casing and said bores, an intermediate portion, in register with said bores, and a lengthwise mouth, opposite said inner portion thereof; and a resilient bail member, defining an inner leg which is endwisely anchored to said casing, a free outer leg, and a web member integrally interconnecting said inner and outer legs, wherein said outer leg has an intermediate section which is releasably engageable through said channel mouth and into said channel, said outer leg intermediate section being sized to fit within said channel inner portion while positively clearing said channel intermediate portion whereby any one pair of axially aligned bores is then freely engageable by the shackle of a padlock for preventing release of said bail outer leg from said channel and thus for anchoring said bail member outer leg to said casing.

2. A monopiece safety lock as defined in claim 1, wherein said inner leg extends generally parallel to said channel.

3. A monopiece safety lock as defined in claim 1, wherein said bail member is generally J-shape, but with said outer leg being pre-tensioned into a released condition which is oriented divergent relative to said inner leg and where said outer leg clears said flanges.

4. A monopiece safety lock as defined in claim 3, wherein the web member of said bail member is deformable, said bail member outer leg defining an enlarged free outer end, and said casing including a notch on its side opposite said bail member inner leg, said outer leg enlarged outer end being sized to fit into said notch and being engageable thereinto upon deformation of said web member and extension of said bail member outer leg.

5. A monopiece safety lock as defined in claim 1, wherein said flanges are parallel to one another.

6. A monopiece safety lock as defined in claim 1, wherein said bail outer leg is longer than said bail inner leg.

* * * * *